United States Patent [19]

Schaming

[11] 4,365,758

[45] Dec. 28, 1982

[54] DESCALING NOZZLE

[76] Inventor: Edward J. Schaming, P.O. Box 1070, Butler, Pa. 16001

[21] Appl. No.: 258,284

[22] Filed: Apr. 28, 1981

[51] Int. Cl.[3] ..... B05B 1/20

[52] U.S. Cl. ..... 239/590; 239/600

[58] Field of Search ..... 239/71, 550, 566, 567, 239/589, 590, 597, 599, 600, 601

[56] References Cited

U.S. PATENT DOCUMENTS

| | | | |
|---|---|---|---|
| 1,889,201 | 11/1932 | Holveck | 239/597 |
| 2,987,262 | 6/1961 | Goyette et al. | 239/600 X |
| 3,273,805 | 9/1966 | Hall | 239/600 X |
| 3,488,006 | 1/1970 | Gigantino | 239/599 |
| 3,771,730 | 11/1973 | Nicoloff et al. | 239/600 X |

*Primary Examiner*—Andres Kashnikow
*Attorney, Agent, or Firm*—D. Paul Weaver

[57] ABSTRACT

A descaling nozzle for hot rolled metal strips in a rolling mill has a more simplified construction for economical manufacturing and ease of installation and replacement of nozzle spray tips. A spray water venturi entrance passage in the body of the nozzle unit maximizes spray power and quiets turbulence. The spray tip angle is preset relative to the body of the nozzle unit and an indicator groove on the body permits exact alignment of each spray tip during assembly on a header. Deep burying of the nozzle unit in the header eliminates plugging of the nozzle entrance passage at start-up and protects the nozzle from external collision damage.

7 Claims, 4 Drawing Figures

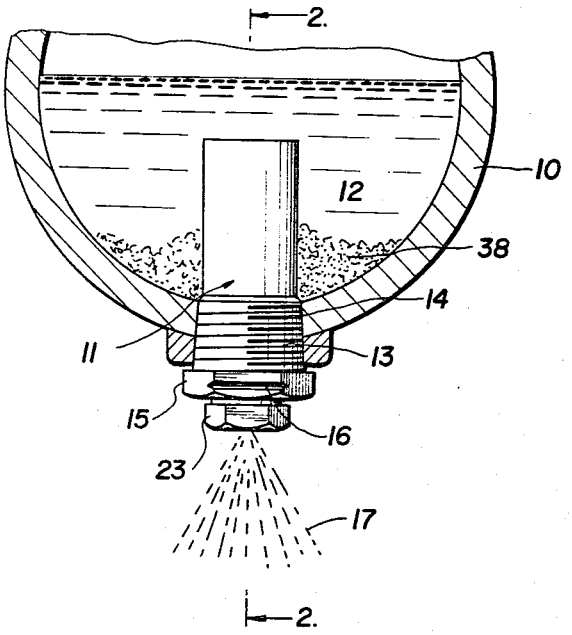
FIG.1
FIG.2
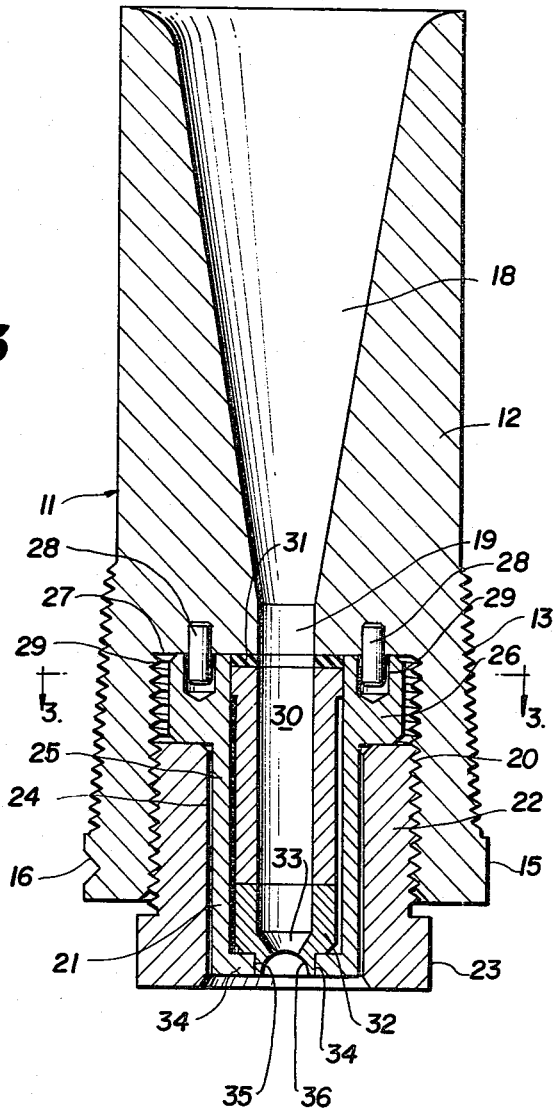
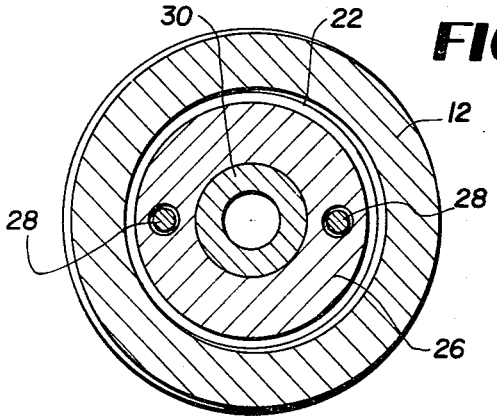
FIG.3
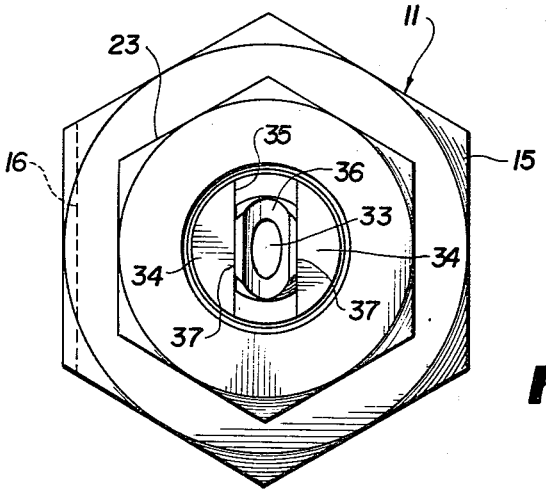
FIG.4

DESCALING NOZZLE

BACKGROUND OF THE INVENTION

Descaling cold water sprays under pressure of approximately 2000 psi commonly employed to remove oxides from metal strips during rolling in a hot rolling mill. In the prior art, various descaling nozzles are known for this purpose. The nozzles are commonly mounted on a water supply header above and across the metal strip for delivery of the well-defined high energy descaling sprays onto the strip. The prior art nozzles vary in their cost and complexity and also in their relative efficiencies.

It is the primary object of this invention to improve on the prior art nozzles for this purpose in a number of important respects.

More particularly, it is a prime object of the invention to provide a descaling nozzle of greater simplicity and easier installation which will deliver onto the metal strip a descaling spray of higher energy and better definition without turbulence. This objective is accomplished by providing a venturi-type nozzle entrance passage which quiets turbulence and increases water velocity through the nozzle tip.

Another objective is to eliminate the need for dirt screens and water diffusers at the inlet of the nozzle in order to prevent dirt clogging and reduced turbulence. This objective is accomplished primarily by burying or recessing the nozzle body deeply in the supply header so that dirt within the header will settle well below the nozzle inlet and will tend not to be drawn into the nozzle at start-up. Another benefit over the prior art achieved by the deep burying of the nozzle in the header is greatly reduced damage to projecting nozzle tips through collision with the hot steel strip or other impact.

Another important object of the invention is to provide more convenient, precise and economical spray alignment means whereby the several nozzle sprays on the header will overlap exactly without interference resulting in loss of spray energy. This objective is accomplished through a precise preset angle alignment for the nozzle tip relative to the nozzle body during assembly of the nozzle components, and the provision on the nozzle body of an indicator groove to permit precise alignment of each spray relative to other sprays and relative to the header when the nozzle bodies are threaded into the header.

Other features and advantages of the invention will become apparent during the course of the following description.

BRIEF DESCRIPTION OF THE DRAWINGS

FIG. 1 is a side elevation of a descaling nozzle according to the invention in relation to the nozzle header which is shown in transverse cross section.

FIG. 2 is an enlarged central vertical longitudinal section through the descaling nozzle taken on line 2—2 of FIG. 1.

FIG. 3 is a horizontal section taken on line 3—3 of FIG. 2.

FIG. 4 is an end elevation of the nozzle.

DETAILED DESCRIPTION

Referring to the drawings in detail wherein like numerals designate like parts, a conventional cold water supply header 10 receiving pressurized water from any convenient source delivers the water to a plurality of descaling nozzles mounted on the header in spaced relationship, in accordance with known practice. The several descaling nozzles deliver pressurized high energy descaling sprays onto a moving metal strip in a hot rolling mill in order to remove rust or oxides therefrom. FIG. 1 depicts a single improved descaling nozzle assembly 11 according to the invention and each such nozzle on the common header 10 is identical in construction and operation.

The nozzle assembly 11 comprises a body 12 in the nature of an elongated cylinder having screw-threads 13 near its forward end for ready engagement in a threaded opening 14 of the header 10. A hexagonal head 15 is formed on the forward end of the body 12 to facilitate threading it into the header and one flat surface of the head 15 is provided with an indicator groove 16 to enable accurate angular alignment of the fan-type descaling spray 17 relative to the header and relative to adjacent nozzle sprays so that the several sprays will overlap with precision in a shingled manner, but without interference which would result in loss of spray energy.

An important feature of the invention is the provision in the rear end nozzle body 12 of a central forwardly tapering conical entrance verturi water inlet passage 18 which extends longitudinally through the body 12 for a major portion of its length, such as two-thirds of its length. The forward end of the tapered passage 18 leads into a restricted short cylindrical passage or throat 19 within which the water moves at increased velocity and reduced pressure toward and through the tip of the nozzle. The throat 19 opens into a substantially enlarged screw-threaded recess 20 in the forward end of the body 12 which receives a preassembled nozzle tip unit 21 and a surrounding externally screw-threaded nozzle tip retainer sleeve 22 having a forward hexagonal head 23. As shown in FIG. 2, the retainer sleeve 22 has threaded engagement in the recess 20 of the nozzle body 12. The retainer sleeve has a cylindrical through bore 24.

The tip unit 21 includes a cylindrical sleeve body 25 insertable into the through bore 24 and having an interior end enlarged cylindrical head 26 which lies in the interior part of threaded recess 20 with its opposite end faces clamped between the inner end of retainer sleeve 22 and the bottom wall 27 of threaded recess 20, which wall is normal to the axis of the nozzle.

A pair of precision angle locator pins 28 for the nozzle tip unit 21 are held in openings formed in the end wall 27 of the nozzle body and these locator pins are received in two locator openings 29 of the head 26 arranged in diametrically opposed relationship on opposite sides of the head.

The bore of sleeve body 25 receives therein an elongated rear nozzle tip spacer sleeve 30 behind which is placed a compressible sealing washer 31 in engagement with the end face or wall 27 and being under compression. Ahead of the spacer sleeve 30 a conventional nozzle tip 32 having a spray orifice 33 rests on forward parallel retaining shoulders 34 of the sleeve body 25, the sleeve body having a cross slot 35 between these two shoulders. The nozzle tip 32 also has an arcuate cross groove 36 at its forward end whose axis is parallel to the sides of the cross slot 35. The nozzle tip 32 also has forward flat parallel faces 37 which are held againt rotation by the parallel sides of the cross slot 35. As shown in FIG. 2, the retaining shoulders 34 are preferably somewhat recessed in the retaining sleeve 22 to avoid contact with outside objects which might damage the nozzle tip. The tip 32 is held firmly between retaining shoulders 34 and spacer sleeve 30 in sleeve body 25 of the nozzle tip unit 21.

When the nozzle components are assembled, the two locator pins 28 establish a preset precision angle for the descaling spray along the major axis of the elliptical orifice 33. When the assembly 12 is threaded into the manifold 10, the indicator groove 16 enables precision alignment of each nozzle orifice relative to the orifices of adjacent nozzles so that the exact spray overlap without interference is assured. All of the sprays will therefore overlap somewhat in shingle fashion and in spaced relationship, and all will have a precision preset angle relative to the oncoming metal strip, not shown, which they collectively span transversely.

Water under required pressure, such as 2000 psi, entering the nozzle body 12 must change its direction of flow 90 degrees which tends to create undesirable turbulence. This tendency is offset by the tapered venturi entrance passage 18 which quiets turbulence and eliminates the need for a diffusing means at the nozzle inlet. The venturi passage accelerates water through the nozzle and reduces its pressure in the restricted throat 19 with the result that the well defined descaling spray impinges on the metal strip with maximum impact force to completely clean it.

Since the body 12 is elongated and is deeply buried in the header 10, dirt particles 38 in the manifold water tend to be trapped well below the mouth of venturi passage 18 at the startup of spraying and are not drawn into the nozzle to clog it. The need for a screen across the inlet mouth of passage 18 is therefore eliminated.

Since the projection of the retaining sleeve 22 from the bottom of the header 10 is slight, the chance of the moving metal strip colliding with and damaging the nozzle assembly is significantly reduced by the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A descaling nozzle comprising a threaded body for placement in a threaded opening of a pressurized fluid header, the screw-threads of said body being near the forward end of the body and the body being elongated and extending substantially rearwardly of the screw-threads, whereby the body can extend deeply into the interior of a header, the body having a rear forwardly tapering venturi entrance passage for fluid, a restricted throat forwardly of the entrance passage and an enlarged forward threaded recess forwardly of said throat, the body having a permanent indicator element on the exterior thereof near its forward end to facilitate precise angular alignment of the nozzle orifice when the descaling nozzle is assembled with a header, a nozzle tip unit disposed within said threaded recess of said body and including a nozzle tip having a spray orifice, precision angle locator means for said orifice on said body and nozzle tip unit, and a threaded retaining sleeve for the nozzle tip unit engaged in said threaded recess of the body and having a through bore receiving said tip unit, and said tip unit including an enlarged head within the threaded recess and inwardly of the threaded retaining sleeve and being clamped between the rear end of the retaining sleeve and the opposing end wall of the threaded recess.

2. A descaling nozzle as defined in claim 1, wherein the forwardly tapering venturi entrance passage is conical and has an included angle of approximately 30 degrees, is coaxial with said restricted throat and spary orifice and extends from the rear end of said body to approximately two-thirds of the distance from the rear end of the body to its forward end.

3. A descaling nozzle as defined in claim 2, and the body having a forward end polygonal turning head, and said indicator element comprising a groove formed in a flat of said turning head.

4. A descaling nozzle as defined in claim 1, and said precision angle locator means comprising a pair of spaced locator pins projecting from the end wall of said threaded recess of the body, and the enlarged head of the nozzle tip unit having locator openings formed therein receiving said locator pins.

5. A descaling nozzle as defined in claim 4, and the nozzle tip unit having a compressible sealing washer at its rear end engaging said end wall of said threaded recess and having a bore coaxial with said restricted throat.

6. A descaling nozzle as defined in claim 5, and the nozzle tip unit including a central internal spacer sleeve ahead of said sealing washer, a nozzle tip element containing said spray orifice ahead of said spacer sleeve and a sleeve body surrounding and containing the spacer sleeve and nozzle tip element and attached to and extending forwardly of said enlarged head and projecting through the bore of said threaded retaining sleeve.

7. A descaling nozzle as defined in claim 6, and forward retaining shoulders for the tip element on said sleeve body of the nozzle tip unit and having flat faces in contact with flat faces of said tip element to prevent rotation thereof.

* * * * *